US005410382A

United States Patent [19]

Matsuda et al.

[11] Patent Number: 5,410,382

[45] Date of Patent: Apr. 25, 1995

[54] PHOTOSENSITIVE MATERIAL DRYING APPARATUS

[75] Inventors: Shinichi Matsuda; Junichi Kose; Ryouei Nozawa; Motoharu Komori, all of Kanagawa, Japan

[73] Assignee: Fuji Photo Film Co., Ltd., Kanagawa, Japan

[21] Appl. No.: 936,657

[22] Filed: Aug. 28, 1992

[30] Foreign Application Priority Data

Aug. 30, 1991 [JP] Japan ..... 3-220449

[51] Int. Cl.[6] ..... G03D 7/00; G03D 15/02

[52] U.S. Cl. ..... 354/300; 354/320; 34/68; 34/639

[58] Field of Search ..... 354/300, 324, 319–323; 34/68, 639, 620, 636, 640

[56] References Cited

FOREIGN PATENT DOCUMENTS 1123236 5/1989 Japan .
258559 12/1990 Japan .

*Primary Examiner*—D. Rutledge
*Attorney, Agent, or Firm*—Sughrue, Mion, Zinn, Macpeak & Seas; Richard C. Turner; Steven M. Gruskin

[57] ABSTRACT

A photosensitive material drying apparatus equipped with a plurality of rollers, which are disposed along a direction of transport of a photosensitive material and form a transport path and which are able to provide heat to the photosensitive material, and a plurality of hot air supplying portions, which blow hot air toward the photosensitive material. The rollers and the hot air supplying portions are disposed such that portions having drying irregularities which occur on surfaces of the photosensitive material, due to the photosensitive material receiving heat from the rollers and from hot air blown from the hot air supplying portions, in accordance with irregularities in a transport speed of the photosensitive material due to driving irregularities in a substantially uniform cycle of the rollers, are scattered substantially evenly on the surfaces of the photosensitive material along the direction of transport thereof. Unevenness on the surfaces of the finished photosensitive material drying irregularities can thereby be prevented.

19 Claims, 6 Drawing Sheets

PHOTOSENSITIVE MATERIAL DRYING APPARATUS

BACKGROUND OF THE INVENTION

1. Field of the Invention

The present invention relates to a photosensitive material drying apparatus, and in particular, a photosensitive material drying apparatus in which a photosensitive material is transported by a plurality of rollers and is dried by being blown by hot air.

2. Description of the Related Art

A conventional photosensitive material drying apparatus in which a photosensitive material, such as a photosensitive material used for graphic arts or a photosensitive material used for X-rays, is dried by being blown by hot air is structured as shown in FIG. 5. In this construction, a plurality of rollers 72 is staggered and disposed at even intervals within a photosensitive material drying apparatus 70. A transport path for a film 74, which is a photosensitive material, is formed in a straight line by the plurality of rollers 72. A plurality of hot air supplying chambers 76 is disposed at vicinities of the rollers 72 on both sides of the transport path of the film 74 so as to sandwich the transport path. The hot air supplying chambers 76 supply hot air generated by a fan and a heater (both unillustrated). A pair of hot air discharge openings 78 is provided respectively at the film transport path side of each of the hot air supplying chambers 76 along the transport path of the film 74. Hot air supplied by the hot air supplying chambers 76 is discharged via the hot air discharge openings 78 toward the surfaces of the film 74, which is positioned between the mutually opposing rollers 72. The film 74 is thereby dried by the hot air.

The rollers 72 are disposed in the photosensitive material drying apparatus 70 and convey the film 74. Mutually opposing ones of the rollers 72 are disposed at uniform intervals. A driving force from an unillustrated driving means is transmitted to the rollers 72 so that the rollers 72 rotate and transport the film 74. Further, the hot air discharge openings 78 are also disposed at even intervals along the transport path of the film 74.

However, in the photosensitive material drying apparatus, the plurality of rollers 72 is rotated by a driving force transmitted from the same drive source. When driving irregularities in a uniform cycle are generated by a drive system near the drive source (for example, faulty meshing of a worm gear and a helical gear), these driving irregularities are transmitted to all of the rollers 72 and are manifested as irregularities in the transport speed of a uniform cycle of the film 74. For example, when an irregularity in the transport speed of a uniform cycle retards the transport speed of the film 74, portions of the photosensitive material to which, when the irregularity in speed is generated, heat is applied by the rollers, which are heated by warm, drying air blown from the hot air discharge openings, or to which heat is applied by the hot air blown from the hot air discharge openings, are dried more quickly than the other portions of the photosensitive material. When the intervals between the rollers or the hot air discharging portions are an integer multiple of a driving irregularity cycle, the portions to which heat is applied, when the driving irregularity is generated, by the heated rollers or by the hot air blown from the hot air supplying portions, are repeatedly exposed to heat as they proceed through the interior of the drying apparatus. Because the drying of these portions is effected particularly rapidly, striped irregularities in gloss appear on the surface of the finished film 74, making the finish of the film 74 unsightly.

SUMMARY OF THE INVENTION

With the aforementioned in view, an object of the present invention is to provide a photosensitive material drying apparatus in which the finish of the dried photosensitive material is not unsightly even if irregularities in the driving of a drive source occur.

In a photosensitive material drying apparatus of a first aspect of the present invention, a photosensitive material transported along a transport path is dried. The photosensitive material drying apparatus is equipped with a plurality of rollers disposed along a direction of transport of said photosensitive material and forming said transport path, said rollers being able to provide heat to said photosensitive material, hot air supplying portions disposed along said transport path, and blowing hot air onto surfaces of said photosensitive material so as to provide heat to surfaces of said photosensitive material, wherein at least one of said rollers and said hot air supply portions are disposed such that portions receiving said heat from at least one of said rollers and said hot air supply portions, of the photosensitive material when a transport speed of said photosensitive material changes relatively due to irregularities in the transport speed of said photosensitive material of substantially uniform cycle arising by said rollers, are located substantially continuously over all areas along a direction of transport, on the surfaces of said photosensitive material.

In a photosensitive material drying apparatus of a second aspect of the present invention, a photosensitive material transported along a transport path is dried. The photosensitive material drying apparatus is equipped with a plurality of rollers disposed along a direction of transport of said photosensitive material and forming said transport path, said rollers being able to provide heat to said photosensitive material, hot air supplying portions disposed along said transport path, and blowing hot air onto surfaces of said photosensitive material so as to provide heat to surfaces of said photosensitive material, wherein at least one of said rollers and said hot air supply portions are disposed such that portions receiving said heat from at least one of said rollers and said hot air supply portions, of the photosensitive material when a transport speed of said photosensitive material changes relatively due to irregularities in the transport speed of said photosensitive material of substantially uniform cycle arising by said rollers, are located at different areas along a direction of transport, on the surfaces of said photosensitive material. Furthermore, in the photosensitive material drying apparatus of the second aspect, at least one of said rollers and said hot air supply portions can be disposed such that said portions receiving heat, of the photosensitive material are located uncontinuously along a direction of transport, on the surfaces of said photosensitive material.

In a photosensitive material drying apparatus of a third aspect of the present invention, a photosensitive material transported along a transport path is dried. The photosensitive material drying apparatus is equipped with a plurality of rollers disposed along a direction of transport of said photosensitive material and forming said transport path, said rollers being able to provide heat to said photosensitive material, hot air supplying portions disposed along said transport path, and blowing hot air onto surfaces of said photosensitive material so as to provide heat to surfaces of said photosensitive material, wherein at least one of said rollers and said hot air supply portions are disposed such that portions receiving said heat from at least one of said rollers and said hot air supply portions, of the photosensitive material when a transport speed of said photosensitive material changes relatively due to irregularities in the transport speed of said photosensitive material of substantially uniform cycle arising by said rollers, receive said heat substantially uniformly repeatedly along a direction of transport, on the surfaces of said photosensitive material. Furthermore, in the photosensitive material drying apparatus of the third aspect, at least one of said rollers and said hot air supply portions can be disposed such that repeating of receiving of said heat on the photosensitive material are performed by repeating receiving uncontinuously said heat along a direction of transport, on the surfaces of said photosensitive material.

In the photosensitive material drying apparatus of the first aspect of the present invention, when a driving irregularity is generated, heat is applied to the photosensitive material from at least one of the rollers and the hot air blown by the hot air supplying portions. The heat is applied to substantially continuously over all areas along a direction of transport, on the surfaces of said photosensitive material. Accordingly, even if an irregularity in the transport speed of a uniform cycle is generated by a driving irregularity of the drive source, heat is supplied to any portions of the photosensitive material. Therefore, irregularities in the gloss and the like of the surfaces of the finished photosensitive material are not generated.

At least one of the intervals between the rollers and the intervals between the hot air supplying portions is changed so that the effects of the heat which the photosensitive material receives from at least one of the hot air blown by the hot air supplying portions and the rollers within the drying apparatus, due to irregularities in transport speed of a uniform cycle caused by driving irregularities, are produced substantially continuously over all areas along a direction of transport, on the surfaces of said photosensitive material.

In this way, by changing at least one of the intervals between the rollers and the intervals between the hot air supplying portions, the positions, at which the photosensitive material is effected by the heat from at least one of the rollers and the hot air blown by the hot air supplying portions, when irregularities in the transport speed of a uniform cycle are generated by driving irregularities, can be changed. The heat effects on the photosensitive material from at least one of the hot air blown by the hot air supplying portions and the rollers, when irregularities in speed of a uniform cycle are generated by driving irregularities, can thereby be scattered or dispersed substantially continuously over all areas along a direction of transport.

In the photosensitive material drying apparatus of the second aspect of the present invention, when a driving irregularity is generated, heat is applied to the photosensitive material from at least one of the rollers and the hot air blown by the hot air supplying portions. The heat is applied to different areas along a direction of transport, on the surfaces of said photosensitive material. Furthermore, the heat can be applied uncontinously along the direction of transport, to the surfaces of the photosensitive material. Accordingly, even if an irregularity in the transport speed of a uniform cycle is generated by a driving irregularity of the drive source, heat is supplied to different areas along the direction of the transport, of the photosensitive material. Therefore, irregularities in the gloss and the like of the surfaces of the finished photosensitive material are not generated.

At least one of the intervals between the rollers and the intervals between the hot air supplying portions is changed so that the effects of the heat which the photosensitive material receives from at least one of the hot air blown by the hot air supplying portions and the rollers within the drying apparatus, due to irregularities in transport speed of a uniform cycle caused by driving irregularities, are produced to different areas along a direction of transport, on the surfaces of said photosensitive material.

In this way, by changing at least one of the intervals between the rollers and the intervals between the hot air supplying portions, the positions, at which the photosensitive material is effected by the heat from at least one of the rollers and the hot air blown by the hot air supplying portions, when irregularities in the transport speed of a uniform cycle are generated by driving irregularities, can be changed. The heat effects on the photosensitive material from at least one of the hot air blown by the hot air supplying portions and the rollers, when irregularities in speed of a uniform cycle are generated by driving irregularities, can thereby be scattered or dispersed to different areas along a direction of transport.

In the photosensitive material drying apparatus of the third aspect of the present invention, when a driving irregularity is generated, heat is applied to the photosensitive material from at least one of the rollers and the hot air blown by the hot air supplying portions. The heat is applied substantially uniformly repeatedly along a direction of transport, to the surfaces of said photosensitive material. Accordingly, even if an irregularity in the transport speed of a uniform cycle is generated by a driving irregularity of the drive source, heat is supplied substantially uniformly repeatedly along the direction of the transport, to the photosensitive material. Therefore, irregularities in the gloss and the like of the surfaces of the finished photosensitive material are not generated. Furthermore, in case that repeating of receiving of said heat on the photosensitive material are performed by repeating receiving uncontinuously said heat along a direction of transport, on the surfaces of said photosensitive material, same effects can be performed.

At least one of the intervals between the rollers and the intervals between the hot air supplying portions is changed so that the heat which the photosensitive material receives from at least one of the hot air blown by the hot air supplying portions and the rollers within the drying apparatus, due to irregularities in transport speed of a uniform cycle caused by driving irregularities, is supplied substantially uniformly repeatedly along a direction of transport, to the surfaces of said photosensitive material.

In this way, by changing at least one of the intervals between the rollers and the intervals between the hot air supplying portions, the positions, at which the photosensitive material is effected by the heat from at least one of the rollers and the hot air blown by the hot air supplying portions, when irregularities in the transport speed of a uniform cycle are generated by driving irregularities, can be substantially uniformly repeated. The heat effects on the photosensitive material from at least one of the hot air blown by the hot air supplying portions and the rollers, when irregularities in speed of a uniform cycle are generated by driving irregularities, can thereby be scattered or dispersed widely along a direction of transport.

As described above, in the photosensitive material drying apparatus relating to the present invention, even if irregularities in the transport speed of a uniform cycle are generated by irregularities in the driving of a drive source, the effects of the heat which the photosensitive material receives from the rollers and from the hot air blown by the hot air supplying portions can be dispersed. As a result, a superior effect can be achieved in that irregularities in drying and the like are not manifested on the surfaces of the finished photosensitive material.

So as not to arise drying irregularities to the photosensitive material, the rollers can be disposed such that at least length of one interval of intervals of rollers is different from length of the other intervals. The rollers can be disposed such that total length of intervals of any continuous at least three rollers is different from total length of intervals of any continuous at least three rollers of which at least one roller is common to some of the former three rollers. Thereby, when the irregularities in the transport speed arise, same portions of photosensitive material transported by at least continuous four rollers can be contacted with the rollers at different times at less times. Such conditions of intervals of the rollers can be applied to all areas of transported photosensitive material. Thereby, when the irregularities in the transport arise, portions contacted with the rollers at different times can be scattered or dispersed over all areas of the photosensitive material.

DESCRIPTION OF THE PREFERRED EMBODIMENTS

A first embodiment of the present invention will be described in detail with reference to the drawings. In the description of the present embodiment, a photosensitive material drying apparatus, to which the present invention is applied, is used in an automatic developer 10 which is a photographic film developing apparatus.

Figure 1:
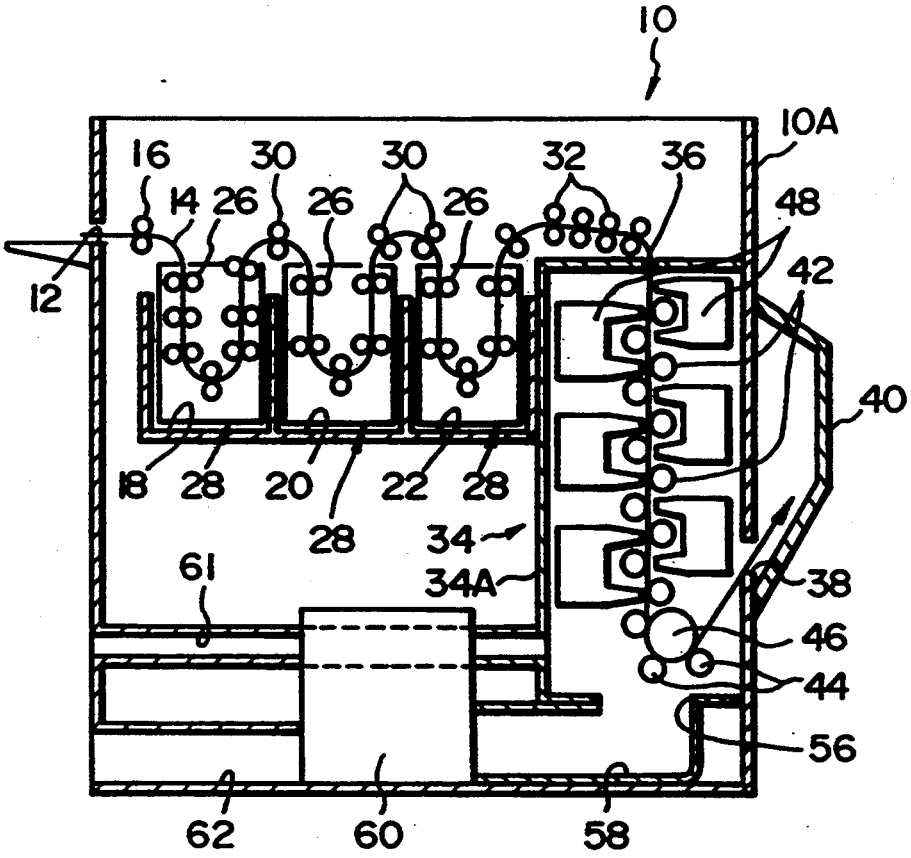
FIG. 1 is a schematic structural view of a photosensitive material drying apparatus relating to first embodiment.

The schematic structure of the automatic developer 10 is illustrated in FIG. 1. A film 14, which is transported inside a frame 10A of the automatic developer 10 from an insertion hole 12, is guided by guide rollers 16. The film 14 passes through a developing tank 18, a fixing tank 20, and a washing tank 22, and reaches a drying portion 34. A rack 28, which is formed by a plurality of guide rollers 26, is respectively accommodated within the developing tank 18, the fixing tank 20, and the washing tank 22. These racks 28 submerge the film 14 into each tank from the liquid surface to the bottom of the tank, turn the film 14, and then guide the film 14 back to the liquid surface.

Guide rollers 30 are respectively disposed between the developing tank 18 and the fixing tank 20, and between the fixing tank 20 and the washing tank 22. The film 14 is successively guided into the subsequent tanks by the guide rollers 30 so that developing, fixing, and washing processes are effected. Further, a plurality of pairs of rollers 32 is disposed between the washing tank 22 and the drying tank 34. The film 14, which has undergone washing processing, is guided by the pairs of rollers 32 from a transport opening 36 to a drying portion main body 34A of the drying portion 34. A portion of the water adhering to the film 14 is squeezed by the pairs of rollers 32.

Figure 2:
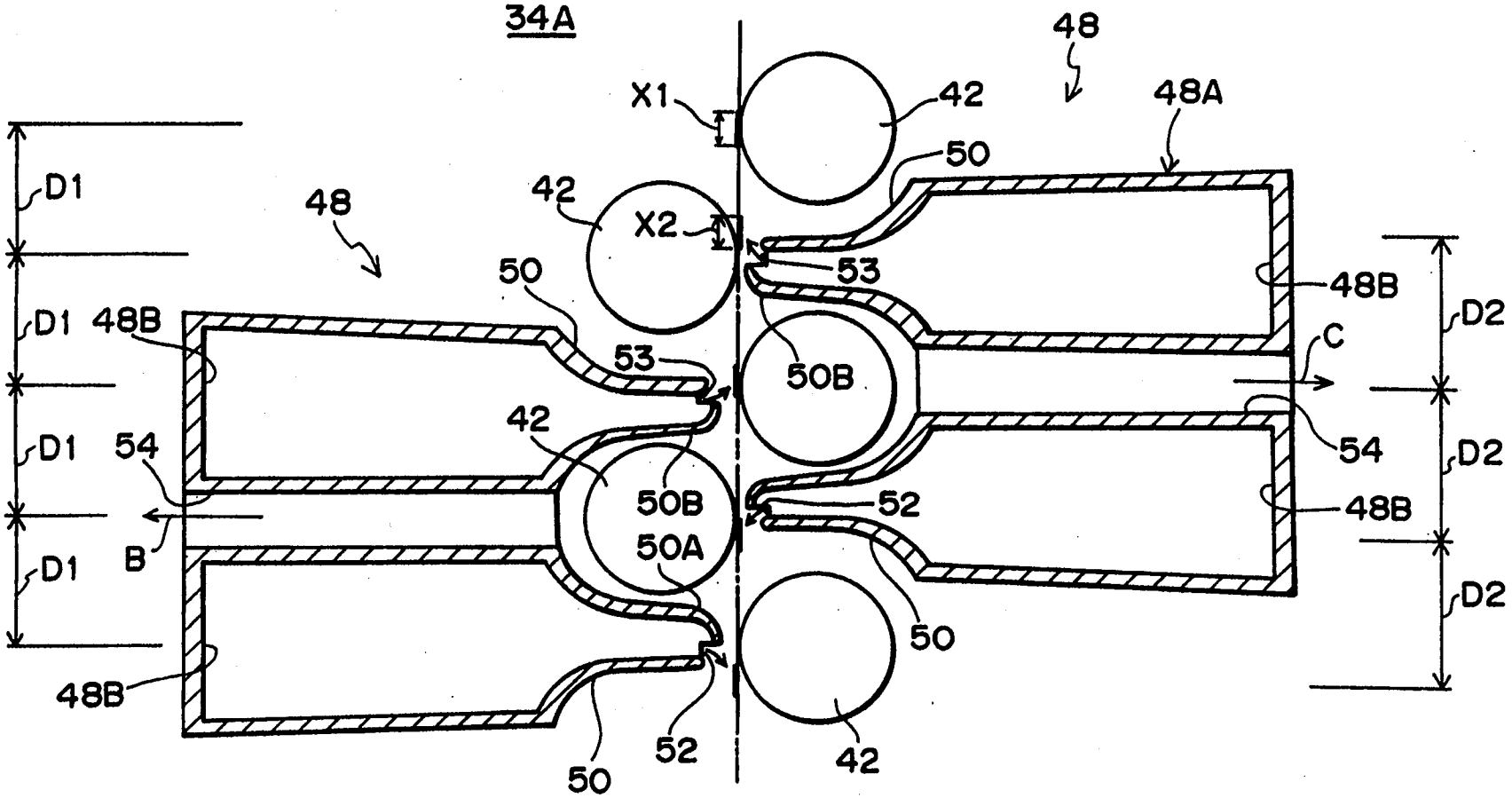
FIG. 2 is a structural view of main portions of a drying portion to which the present invention is applied.

A portion of the interior of the drying portion main body 34A is illustrated in FIG. 2. A plurality of rollers 42 is disposed so as to be staggered within the drying portion main body 34A. The rollers 42 form a transport path for the film 14. A driving force from an unillustrated drive source is transmitted to the rollers 42 such that the rollers 42 are each rotated at the same speed. The film 14 is transported by this rotation. The distance between adjacent rollers 42 is a uniform length D1. The rollers 42 are heated by hot, drying air blown from hot air discharge openings 52, 53, which will be described later. Accordingly, by contacting the roller 42, the film 14 is effected by heat over a length X1 in the direction of transport. Incidentally, in the present embodiment, D1 is 18 mm.

Further, as shown in FIG. 1, three guide rollers 44, which have the same diameter as the roller 42, and a guide roller 46, whose diameter is larger than that of the roller 42, are disposed in a lower portion of the interior of the drying portion main body 34A. The rollers 44, 46 are respectively supported by the drying portion main body 34A so as to be rotatable. The rollers 44, 46 are rotated by a drive force from an unillustrated driving means so as to turn the film 14, which is guided through the lower portion of the drying portion main body 34A. The film 14 is thereby transported through a transport opening 38 to a film receiving box 40 mounted on the outer side of the frame 10A.

As shown in FIG. 2, hot air supplying chambers 48 are disposed in vicinities of each of the rollers 42 so as to sandwich the transport path of the film 14. The hot air supplying chambers 48 are disposed such that the longitudinal direction (the direction perpendicular to the surface of the drawing in FIG. 2) thereof is disposed along the transverse direction of the film 14. The longitudinal dimension of the hot air supplying chamber 48 is longer than the transverse dimension of the film 14. An opening portion 48B is provided at one end of each of the hot air supplying chambers 48 in the longitudinal direction thereof. Hot air, which is generated by a fan 60 and a heater which will be described later, is supplied through the opening portions 48B.

At the hot air supplying chamber 48, a pair of hot air discharging portions 50 is formed so as to protrude toward the transport path of the film 14 and so as to extend along the longitudinal direction of the hot air supplying chamber 48. The interior of the hot air discharging portion 50 is hollow and communicates with the interior of the hot air supplying chamber 48. At end portions of the pair of hot air discharging portions 50, hot air discharge openings 52, 53 are formed. The hot air discharge openings 52, 53 are provided so as to lean toward ones of ends in the transverse direction of the hot air discharging portions 50. The other ends in the transverse direction of the hot air discharging portions 50 are formed as arcuate portions 50A, 50B. The dimension in the transverse direction (the left-to-right and right-to-left directions as shown in FIG. 2) of the hot air supplying chamber 48 gradually becomes smaller from the opening portion 48B, provided at one end in the longitudinal direction of the hot air supplying chamber 48, to the other end portion thereof. The cross-sectional area of the hot air supplying chamber 48 also gradually becomes smaller from the opening portion 48B end to the other end.

In this way, the hot air supplied to the interior of the hot air supplying chamber 48 is guided to the end portion of the hot air discharging portion 50. The hot air is discharged substantially evenly, along the transverse direction of the film 14, onto the film 14 at a vicinity downstream from the roller 42 by the hot air discharge opening 52 and the arcuate portion 50A, or onto the film 14 at an vicinity upstream from the roller 42 by the hot air discharge opening 53 and the arcuate portion 50B.

Further, discharge openings 54 are provided at the hot air supplying chamber 48 between the pair of hot air discharging portions 50. The discharge opening 54 communicates the transport path side of the air supplying chamber 48 and the side opposite the transport path side. The discharge opening 54 extends alone the longitudinal direction of a base portion 48B of the hot air discharging portion 50 such that air in a vicinity of the transport path of the film 14 can be discharged in the directions of arrows B, C in FIG. 2.

The hot air discharged from the hot air discharge openings 52, 53 heats the surface of the film 14 for a length X2 along the direction of transport of the film 14. Further, the pitches at which the hot air discharged from the hot air discharge openings 52, 53 contacts the surface of the film 14 are even intervals of length D2 along the transport path from the upstream side of the transport path. In the present embodiment, the length D2 is 18 mm.

As shown in FIG. 1, an air outlet 56 is provided at a bottom portion of the drying portion main body 34A. One end of a return duct 58 is connected to the air outlet 56. Another end of the return duct 58 is connected to the suction side of the fan 60. A suction duct 62, which communicates with the exterior of the frame 10A, is connected to an intermediate portion of the return duct 58.

An exhaust duct 61, which discharges humid air within the drying portion main body 34A, is provided in the drying portion main body 34A. A portion of the hot air blown onto the film 14 by the hot air discharge openings 52, 53 is discharged via the discharge openings 54 and the spaces between adjacent hot air supplying chambers 48, is guided to the lower portion of the drying portion main body 34A, and is discharged to the exterior of the frame 10A via the exhaust duct 61. A portion of or the majority of the hot air guided to the lower portion of the drying portion main body 34A is guided to the suction side of the fan 60 via the air outlet 56 and the return duct 58. Further, air outside of the frame 10A is guided to the suction side of the fan 60 via the suction duct 62.

Due to the ratio of the cross-sectional areas of the passages of the return duct 58 and the suction duct 62, approximately 80% of the air guided to the suction side of the fan 60 is air which flows in from the drying portion main body 34A. Approximately 20% of the air guided to the suction side of the fan 60 is air which flows in from the exterior of the frame 10A.

Figure 3:
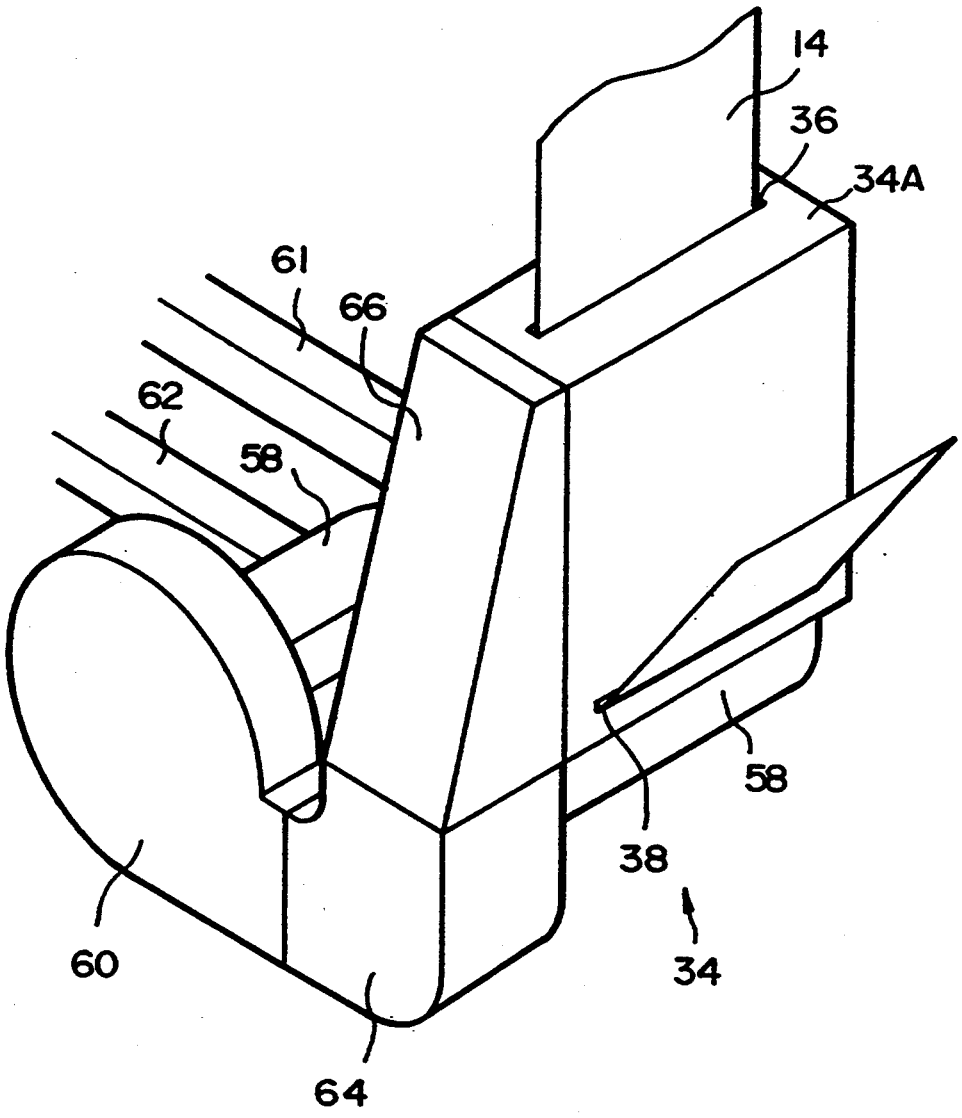
FIG. 3 is a perspective view of main portions illustrating the drying portion relating to the first embodiment.

As shown in FIG. 3, one end of a heater box 64, in which an unillustrated heater is disposed, is mounted to one end of the fan 60. A central portion of the heater box 64 is bent so as to form a right angle. Air guided to the suction side of the fan 60 is sent out from the exhaust side by the fan 60 as air flow. The air is heated by the heater within the heater box 64 and is sent out as hot air.

A duct 66, which is provided at a side surface of the drying portion main body 34A along the direction of transport of the film 14, is mounted to another end of the heater box 64. The duct 66 communicates with the interiors of each of the hot air supplying chambers 48 via openings which are provided so as to correspond to the opening portions 48B of the hot air supplying chambers 48. In this way, the hot air sent from the heater box 64 is supplied to the hot air supplying chambers 48. Further, the cross-sectional area of the passage of the duct 66 gradually becomes larger along the longitudinal direction of the duct 66, i.e., along the direction of transport of the film 14. The flow rate per unit time of the hot air supplied to each of the hot air supplying chambers 48 which diverge from the duct 66 is approximately equal.

In the automatic developer 10, a driving force from the same drive source (not shown) is transmitted to each roller. The driving force of this drive source is transmitted to each roller of the drying portion main body 34A as well. Irregularities in rotation are sometimes generated in a constant cycle in the driving force of the drive source due to the relationship of the meshing of the gears or the like. As a result, irregularities in speed in a constant cycle occur in the transport speed of the film 14. In the drying portion main body 34A applied to the present embodiment, the cycle L in which an irregularity in driving occurs is approximately 8 mm.

Next, operation of the present embodiment will be described.

As shown in FIG. 1, in the automatic developer 10, the film 14, on which images are printed and which is inserted from the transport opening 12, undergoes developing, fixing, and washing processing. Thereafter, the film 14 is squeezed by the pairs of rollers 32 and is sent from the transport opening 36 into the drying portion main body 34A of the drying portion 34.

Within the drying portion main body 34A, as the plurality of rollers 42 transports the film 14 downward, hot air discharged from the hot air discharge openings 52, 53 of the hot air discharging portions 50 is blown on the surfaces of the film 14 so as to dry the film 14. At this time, hot air is discharged to the surfaces of the film 14 by the inclined hot air discharge openings 52 and the arcuate portions 50A, and by the hot air discharge openings 53 and the arcuate portions 50B.

The film 14, which has been dried within the drying portion main body 34A, is turned by the guide rollers 44, 46 at the bottom portion of the drying portion main body 34A. The film 14 is then discharged as finished film from the transport opening 38 to the film receiving box 40 outside the frame 10A.

Next, an explanation will be given of a case in which irregularities in the transport speed of the film 14 occur when the film 14 is transported within the drying portion main body 34A. Namely, an explanation of the effects of the irregularities in the driving of the drive source is given below.

Figure 4:
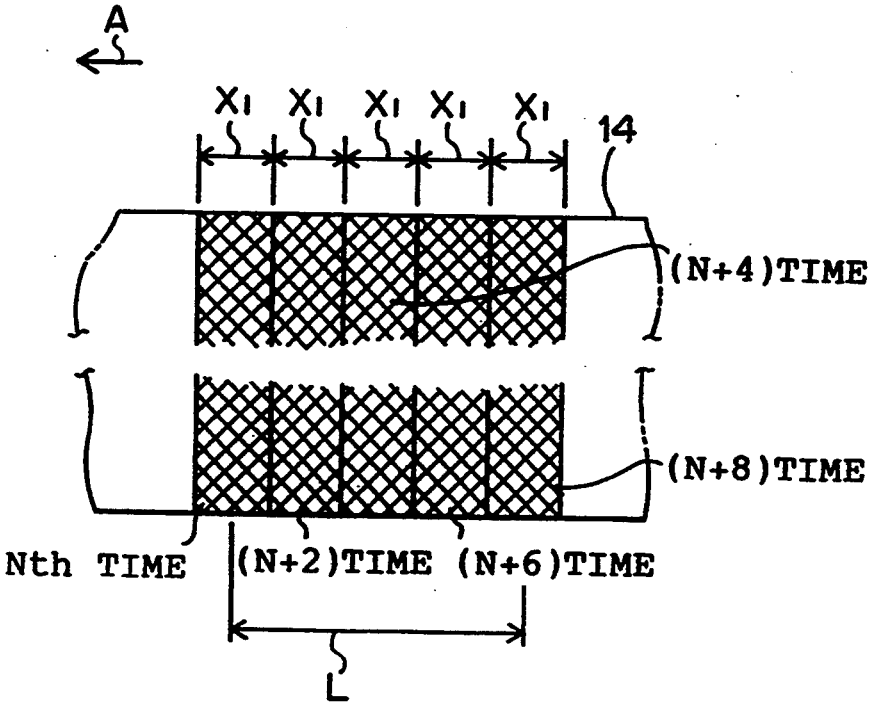
FIG. 4 is a plan view of a film showing a range which is effected by heat from rollers.
Figure 5:
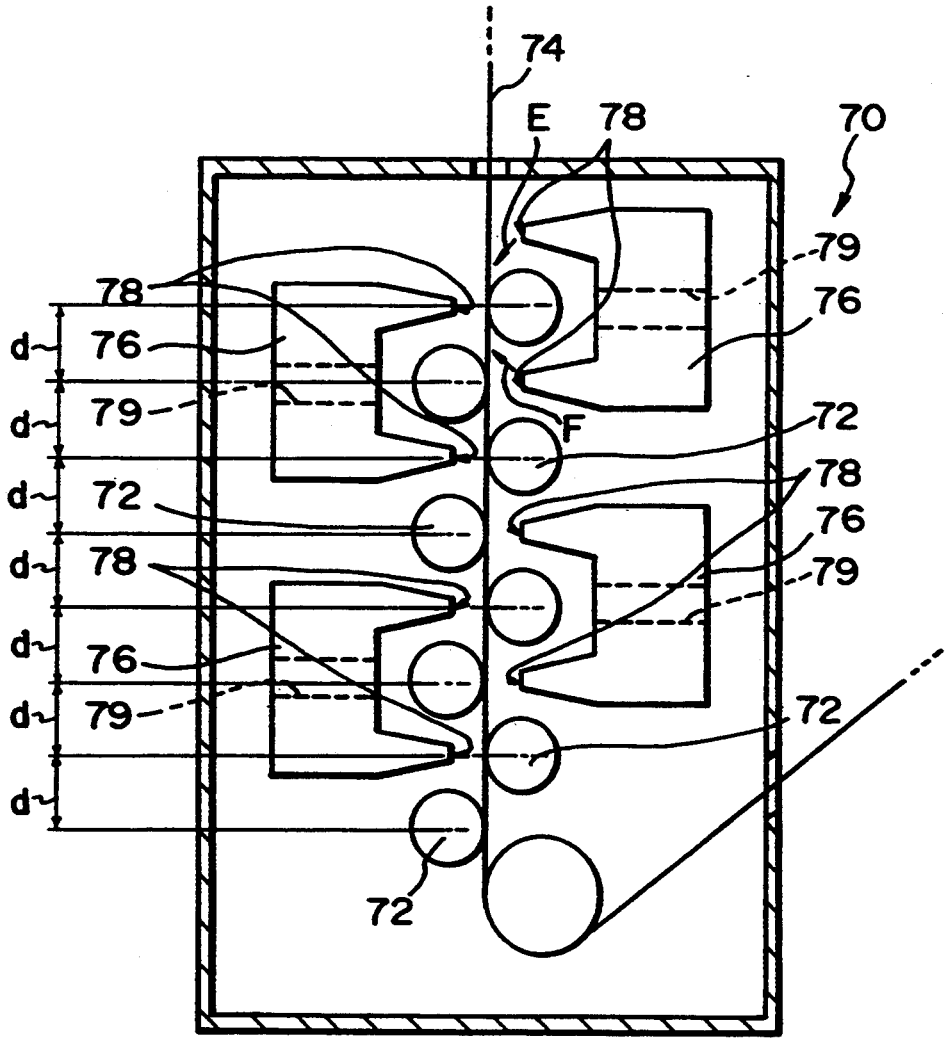
FIG. 5 PRIOR ART
FIG. 5 is a structural view of main portions illustrating a conventional example of a drying portion.

As an example, the irregularity in the driving of the drive source occurs each time the film 14 is transported 8 mm by the rollers 42 of the drying portion main body 34A. When this driving irregularity occurs, the film 14 contacts the roller 42. The length X1, along the direction of transport of the film 14, which is effected by the heat from the roller 42 is 2 mm. As shown in FIG. 4, the portion of the cycle L of the driving irregularity along the transport direction of the film 14 is illustrated by the portion which is effected by heat from the roller 42 when the film 14 and the roller 42 contact each other when the driving irregularity occurs. Incidentally, arrow A in FIG. 4 denotes the direction of transport of the film 14.

Namely, at a portion of L of an arbitrary position of the film 14, when the roller 42 contacts the film 14 for the Nth time a driving irregularity occurs, the position at which the film contacts the roller when the driving irregularity occurs moves in order, At a portion of the driving irregularity cycle L, the roller 42 and the film 14 alternately miss four times and contact each other at the Nth time, the (N+2) time, the (N+4) time, the (N+6) time, and the (N+8) time.

In this way, the portion of the film 14, which contacts the roller 42 when the eighth driving irregularity occurs, moves a constant interval. Further, by the rollers 42 contacting the film 14 when the driving irregularities occur, the effects of the heat from the rollers 42 are approximately uniform. In this way, irregularities in gloss do not appear on the surfaces of the negative film 14 which has been dried in and discharged from the drying portion main body 34A.

The effects of the hot air discharged from the hot air discharge openings 52, 53 can produce the same results on the film 14 when irregularities in driving are generated. In this case, size of above stated X2 is 2.5 mm. Even if driving irregularities do occur, the finish of the film 14 is not marred.

The following measure may be taken in order to prevent the film 14 from being effected, due to driving irregularities, by heat from at least one of the rollers 42 and the hot air blown by the hot air discharge openings 52, 53. When the length of the film 14 which is transported within the cycle in which the driving irregularity occurs is L, i.e., when the driving irregularity cycle is L, and X is the range on the film 14 which is effected by heat from at least one of the rollers 42 and the hot air blown by the hot air discharge openings 52, 53, the rollers 42 or the hot air discharge openings 52, 53 can be provided at even intervals D defined as follows.

$$D=k\times L+X \text{ or } D=k\times L-X$$

(wherein k is an integer greater than or equal to 1)

In this way, even if driving irregularities occur, the film 14 within the drying portion main body 34A receives a uniform effect from at least one of the rollers 42 and the hot air blown by the hot air discharge openings 52, 53 when the driving irregularities occur. Further, if the length D is applied to the rollers 42 or the hot air discharge openings 52, 53, they may be provided at uneven intervals.

The present embodiment is described as an example in which at least one of the rollers 42 and the hot air discharge openings 52, 53 is disposed so that the portions of the film 14, which are effected by heat from at least one of the rollers 42 and the hot air blown by the hot air discharge openings 52, 53 when driving irregularities occur, move in order. However, the present embodiment is not limited to the same. The objects of the present invention can be achieved if the range of the driving irregularity cycle L at an arbitrary position of the film 14, is between the time the film 14 is inserted into the drying portion main body 34A and the time the film 14 is dried and discharged from the drying portion main body 34A, and effects of the heat from at least one of the rollers 42 and the hot air blown by the hot air discharge openings 52, 53 when the driving irregularity occur are dispersed or scattered on the film 14.

Further, in the present embodiment, the rollers and the hot air supplying portions were arranged so as to be staggered within the drying portion main body 34A. However, an arrangement in which the rollers and the hot air supplying portions oppose each other can also be applied to the present invention.

Figure 6:
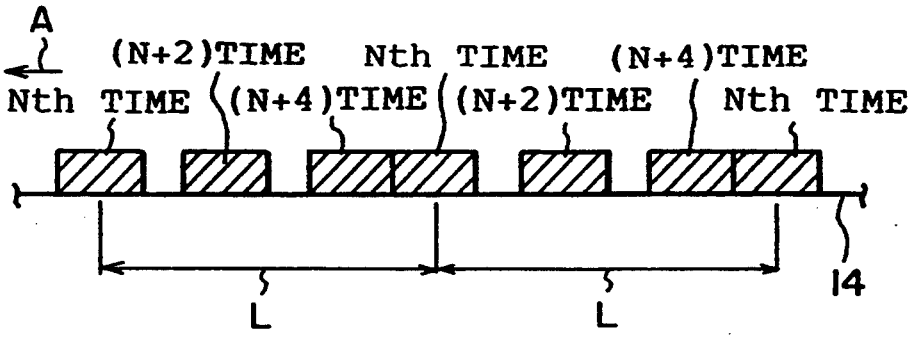
FIG. 6 is a typical view showing portions which are effected by heat on the photosensitive material relating to second embodiment.

A second embodiment of the present invention is stated below. Structure and function which are particular in the second embodiment are only described here, explanation of the other structure and function is omitted here because the other structure and function is common to one of the first embodiment. In this embodiment, the rollers 42 and hot air discharge openings 52,53 are disposed such that portions which receive heat by the rollers 42 and the hot air blown by the hot air discharge openings 52, 53, on the photosensitive material are dispersed or scattered. A case for the rollers 42 is explained below. In this embodiment, Y is used in D of the above stated formula instead of the X. Y is more than X, and is same or less than 1.5X. As shown in FIG. 6, at a portion of L of an arbitrary position of the film 14, when the film 14 receive heat from the rollers 42 when the Nth time driving irregularity occurs, the position at which the film 14 receives effects of heat when the driving irregularity occurs moves in order. At a portion of the driving irregularity cycle L, the portions receiving effects of the heat moves in order two times at the Nth time, the (N+2) time, and the (N+4) time. There is a portion which do not receive the heat effects between each of portions receiving the heat effects. The portions which receive the heat effects are not continuous along the direction of transport, on the film 14. Length along the direction of the transport, of each of the portions which does not receive the heat effects is half or less of length along the direction of the transport, of each of the portions which receives the heat effects by the rollers 42. Each pattern of portions which receive the heat effects in the cycle of the driving irregularity is same and the pattern is repeated.

In case that the portions which receive the heat effects are dispersed or scattered, the length along the direction of the transport, of the portion which does not receive the heat effects is the size stated above, striped irregularities in gloss do not appear on the surfaces of the negative film 14 and the finish of the film 14 is not made unsightly.

The effects of the hot air discharged from the hot air discharge openings 52, 53 can produce the same results on the film 14 when irregularities in driving are generated. Even if driving irregularities do occur, the finish of the film 14 is not marred.

A third embodiment of the present invention is described below. Structure and function which are particular in the third embodiment are only described here, explanation of the other structure and function is omitted here because the other structure and function is common to one of the second embodiment.

Figure 7:
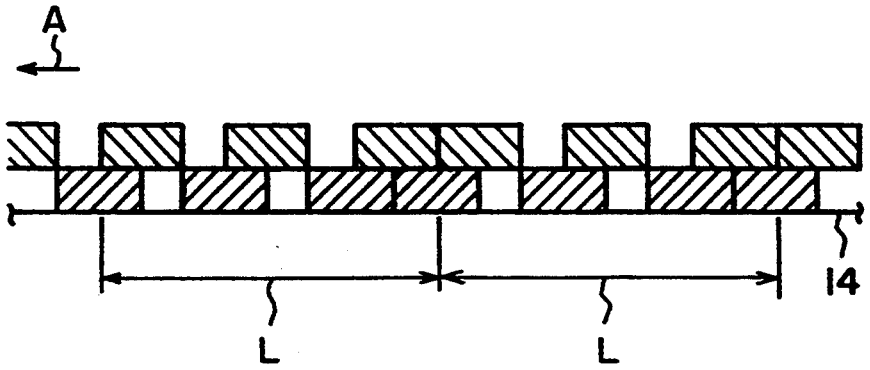
FIG. 7 a typical view showing portions which are effected by heat on the photosensitive material relating to third embodiment.

Even if the heat which the film 14 receives by the rollers 42 and the hot air blown by the hot air discharge openings 52, 53 is applied to the film 14 repeatedly as shown in the FIG. 7, in case that the heat can be applied substantially uniformly repeatedly along a direction of transport, to the film 14, the rollers 42 and the hot air discharge openings 52, 53 can be disposed so as to occur such results.

A case for the rollers 42 is explained below. In this embodiment, the film 14 receives the heat which the rollers 42 applies first time in the pattern stated in the second embodiment. The film 14 receives the heat which the rollers 42 applies second time in the pattern in the first time, however, the pattern is shifts. Accordingly, portions which receive the heat two times exist on the film 14, and portions which receive the heat only one time also exists on the film 14, as shown in FIG. 7. Each pattern of portions which receive the heat effects in the cycle of the driving irregularity is same and the pattern is repeated.

Even if the heat is applied to the film 14 repeatedly, when the heat is applied substantially uniformly in the direction of the transport, to the film 14 repeatedly and portions to which the heat is not applied do not exist, striped irregularities in gloss do not appear on the surfaces of the film 14 and the finish of the film 14 is not made unsightly.

The effects of the hot air discharged from the hot air discharge openings 52, 53 can produce the same results on the film 14 when irregularities in driving are generated. Even if driving irregularities do occur, the finish of the film 14 is not marred.

The heat can be applied to the film 14 three times or more. In this case, portions to which the heat is applied less than the other portions for one time can be existed on the film 14 transported during the driving irregularity cycle, however, portions to which the heat is applied less than the other portions for two times should not be existed on the film 14.

What is claimed is:

1. A photosensitive material drying apparatus for drying a photosensitive material transported along a transport path, comprising;

a plurality of rollers disposed along a direction of transport of said photosensitive material and forming said transport path, said rollers being able to provide heat to said photosensitive material;

hot air supply portions disposed along said transport path, and blowing hot air onto surfaces of said photosensitive material so as to provide heat to surfaces of said photosensitive material;

wherein at least one of said rollers and said hot air supply portions are disposed over said photosensitive material such that portions of the photosensitive material more greatly dried by receiving more of said heat, compared to remaining portions of the photosensitive material, from said at least one of said rollers and said hot air supply portions, are located substantially continuously over all areas, along a direction of transport, on the surfaces of said photosensitive material even during an irregularity in transport speed of said photosensitive material having a substantially uniform cycle.

2. A photosensitive material drying apparatus according to claim 1, wherein at least one of said rollers and said hot air supply portions are disposed at an interval, said interval being one of an amount slightly longer than or an amount slightly shorter than an integer multiple of a length of said photosensitive material transported within a cycle of an occurrence of said irregularity in transport speed.

3. A photosensitive material drying apparatus according to claim 2, wherein said slight amount is a length, in the direction of transport of said photosensitive material, of a range in which said photosensitive material is affected by heat from at least one of said rollers and said hot air supply portions.

4. A photosensitive material drying apparatus for drying a photosensitive material transported along a transport path, comprising;

a plurality of rollers disposed along a direction of transport of said photosensitive material and forming said transport path, said rollers being able to provide heat to said photosensitive material;

hot air supply portions disposed along said transport path, and blowing hot air onto surfaces of said photosensitive material so as to provide heat to surfaces of said photosensitive material;

wherein at least one of said rollers and said hot air supply portions are disposed over said photosensitive material such that portions of the photosensitive material more greatly dried by receiving more of said heat, compared to remaining portions of the photosensitive material, from said at least one of said rollers and said hot air supply portions, are located substantially continuously over all areas, along a direction of transport, on the surfaces of said photosensitive material;

wherein among intervals at which at least one of said rollers and said hot air supply portions are disposed, there are intervals which are of an amount slightly longer than and intervals which are of an amount slightly shorter than an integer multiple of a length of said photosensitive material transported within a cycle of an occurrence of an irregularity in transport speed.

5. A photosensitive material drying apparatus according to claim 4, wherein said slight amount is a length, in the direction of transport of said photosensitive material, of a range in which said photosensitive material is affected by heat from at least one of said rollers and said hot air supply portions.

6. A photosensitive material drying apparatus for drying a photosensitive material transported along a transport path, comprising:

a plurality of rollers disposed along a direction of transport of said photosensitive material and forming said transport path, said rollers being able to provide heat to said photosensitive material;

hot air supply portions disposed along said transport path, and blowing hot air onto surfaces of said photosensitive material so as to provide heat to surfaces of said photosensitive material;

wherein at least one of said rollers and said hot air supply portions are disposed over said photosensitive material such that portions of the photosensitive material more greatly dried by receiving more of said heat, compared to remaining portions of the photosensitive material, from said at least one of said rollers and said hot air supply portions are located at different areas, along a direction of transport, on the surfaces of said photosensitive material, at least one of said rollers and said hot air supply portions being disposed such that said portions of the photosensitive material receiving heat are located, along a direction of transport, discontinuously in a predetermined pattern on the surface of said photosensitive material even during an irregularity in transport speed of said photosensitive material having a substantially uniform cycle.

7. A photosensitive material drying apparatus according to claim 6, wherein each interval at which at least one of said rollers and said hot air supply portions are disposed, is one of an amount slightly longer than or an amount slightly shorter than an integer multiple of a length of said photosensitive material transported within a cycle of an occurrence of said irregularity in transport speed.

8. A photosensitive material drying apparatus according to claim 7, wherein said slight amount is a length, in the direction of transport of said photosensitive material, of a range in which said photosensitive material is affected by heat from at least one of said rollers and said hot air supply portions.

9. A photosensitive material drying apparatus for drying a photosensitive material transported along a transport path, comprising:

a plurality of rollers disposed along a direction of transport of said photosensitive material and forming said transport path, said rollers being able to provide heat to said photosensitive material;

hot air supply portions disposed along said transport path, and blowing hot air onto surfaces of said photosensitive material so as to provide heat to surfaces of said photosensitive material;

wherein at least one of said rollers and said hot air supply portions are disposed over said photosensitive material such that portions of the photosensitive material more greatly dried by receiving more of said heat, compared to remaining portions of the photosensitive material, from said at least one of said rollers and said hot air supply portions are located at different areas, along a direction of transport, on the surfaces of said photosensitive material, at least one of said rollers and said hot air supply portions being disposed such that said portions of the photosensitive material receiving heat are located, along a direction of transport, discontinuously on the surface of said photosensitive material;

wherein a length of portions which do not receive said heat, in the direction of transport, on the surface of said photosensitive material are half or less than half in length, in the direction of transport, of the length of said portions of said photosensitive material which do receive said heat.

10. A photosensitive material drying apparatus for drying a photosensitive material transported along a transport path, comprising:

a plurality of rollers disposed along a direction of transport of said photosensitive material and forming said transport path, said rollers being able to provide heat to said photosensitive material;

hot air supply portions disposed along said transport path, and blowing hot air onto surfaces of said photosensitive material so as to provide heat to surfaces of said photosensitive material;

wherein at least one of said rollers and said hot air supply portions are disposed over said photosensitive material such that portions of the photosensitive material more greatly dried by receiving more of said heat, compared to remaining portions of the photosensitive material, from said at least one of said rollers and said hot air supply portions are located at different areas, along a direction of transport, on the surfaces of said photosensitive material, at least one of said rollers and said hot air supply portions being disposed such that said portions of the photosensitive material receiving heat are located, along a direction of transport, discontinuously, in a predetermined pattern, on the surface of said photosensitive material;

wherein among intervals at which at least one of said rollers and said hot air supply portions are disposed, there are intervals which are of an amount slightly longer than or intervals which are of an amount slightly shorter than an integer multiple of a length of said photosensitive material transported within a cycle of an occurrence of an irregularity in transport speed.

11. A photosensitive material drying apparatus according to claim 10, wherein said slight amount is a length, in the direction of transport of said photosensitive material, of a range in which said photosensitive material is affected by heat from at least one of said rollers and said hot air supply portions.

12. A photosensitive material drying apparatus for drying a photosensitive material transported along a transport path, comprising:

a plurality of rollers disposed along a direction of transport of said photosensitive material and forming said transport path, said rollers being able to provide heat to said photosensitive material;

hot air supply portions disposed along said transport path, and blowing hot air onto surfaces of said photosensitive material so as to provide heat to surfaces of said photosensitive material;

wherein at least one of said rollers and said hot air supply portions are disposed over said photosensitive material such that portions of the photosensitive material more greatly dried by receiving more of said heat, compared to remaining portions of said photosensitive material, from said at least one of said rollers and said hot air supply portions, are located repeatedly substantially uniformly along a direction of transport, on the surfaces of said photosensitive material even during an irregularity in transport speed of said photosensitive material having a substantially uniform cycle.

13. A photosensitive material drying apparatus according to claim 12, at least one of said rollers and said hot air supply portions being disposed such that said repeated receiving of said heat on said more greatly dried portions of the photosensitive material are performed by repeatedly drying by receiving said heat, along a direction of transport, discontinuously on the surface of said photosensitive material.

14. A photosensitive material drying apparatus according to claim 12, wherein each interval at which at least one of said rollers and said hot air supply portions are disposed, is one of an amount slightly longer than and an amount slightly shorter than an integer multiple of a length of said photosensitive material transported within a cycle of an occurrence of said irregularity in transport speed.

15. A photosensitive material drying apparatus according to claim 14, wherein said slight amount is a length, in the direction of transport of said photosensitive material, of a range in which said photosensitive material is affected by heat from at least one of said rollers and said hot air supply portions.

16. A photosensitive material drying apparatus for drying a photosensitive material transported along a transport path, comprising:

a plurality of rollers disposed along a direction of transport of said photosensitive material and forming said transport path, said rollers being able to provide heat to said photosensitive material;

hot air supply portions disposed along said transport path, and blowing hot air onto surfaces of said photosensitive material so as to provide heat to surfaces of said photosensitive material;

wherein at least one of said rollers and said hot air supply portions are disposed such that portions of the photosensitive material more greatly dried by receiving more of said heat, compared to remaining portions of said photosensitive material, from said at least one of said rollers and said hot air supply portions, are located repeatedly substantially uniformly along a direction of transport, on the surfaces of said photosensitive material;

at least one of said rollers and said hot air supply portions being disposed such that said repeated receiving of said heat on said more greatly dried portions of the photosensitive material are performed by repeatedly drying by receiving said heat, along a direction of transport, discontinuously on the surface of said photosensitive material; and at least one of said rollers and said hot air supply portions being disposed such that within a cycle of an occurrence of irregularity in the transport speed, on the surfaces of said photosensitive material there are portions which receive said heat repeatedly at predetermined times and portions which receive said heat repeatedly at least once more than said predetermined times.

17. A photosensitive material drying apparatus for drying a photosensitive material transported along a transport path, comprising:

a plurality of rollers disposed along a direction of transport of said photosensitive material and forming said transport path, said rollers being able to provide heat to said photosensitive material;

hot air supply portions disposed along said transport path., and blowing hot air onto surfaces of said photosensitive material so as to provide heat to surfaces of said photosensitive material;

wherein at least one of said rollers and said hot air supply portions are disposed such that portions of the photosensitive material more greatly dried by receiving more of said heat, compared to remaining portions of said photosensitive material, from said at least one of said rollers and said hot air supply portions, are located repeatedly substantially uniformly along a direction of transport, on the surfaces of said photosensitive material;

at least one of said rollers and said hot air supply portions being disposed such that said repeated receiving of said heat on said more greatly dried portions of the photosensitive material are performed by repeatedly drying by receiving said heat, along a direction of transport, discontinuously on the surface of said photosensitive material;

wherein a length, in the direction of transport, of portions of said photosensitive material which do not receive said heat on the surface of said photosensitive material, are half or less than half in length, in the direction of transport, of the length of said portions of said photosensitive material which do receive said heat.

18. A photosensitive material drying apparatus for drying a photosensitive material transported along a transport path, comprising:

a plurality of rollers disposed along a direction of transport of said photosensitive material and forming said transport path, said rollers being able to provide heat to said photosensitive material;

hot air supply portions disposed along said transport path, and blowing hot air onto surfaces of said photosensitive material so as to provide heat to surfaces of said photosensitive material;

wherein at least one of said rollers and said hot air supply portions are disposed such that portions of the photosensitive material more greatly dried by receiving more of said heat, compared to remaining portions of said photosensitive material, from said at least one of said rollers and said hot air supply portions, are located repeatedly substantially uniformly along a direction of transport, on the surfaces of said photosensitive material;

wherein among intervals at which at least one of said rollers and said hot air supply portions are disposed, there are intervals which are of an amount slightly longer than and intervals which are of an amount slightly shorter than an integer multiple of a length of said photosensitive material transported within a cycle of an occurrence of an irregularity in transport speed.

19. A photosensitive material drying apparatus according to claim 18, wherein said slight amount is a length, in the direction of transport of said photosensitive material, of a range in which said photosensitive material is affected by heat from at least one of said rollers and said hot air supply portions.

* * * * *